US009381553B2

(12) United States Patent
Schmidt

(10) Patent No.: US 9,381,553 B2
(45) Date of Patent: Jul. 5, 2016

(54) METHOD AND ROLLING TRAIN FOR ROLLING A ROLLED STOCK PRODUCED IN AN INGOT CASTING PROCESS, OPEN- AND/OR CLOSED-LOOP CONTROL DEVICE FOR A ROLLING TRAIN, MACHINE-READABLE PROGRAM CODE FOR AN OPEN- AND/OR CLOSED-LOOP CONTROL DEVICE, AND STORAGE MEDIUM

(75) Inventor: Birger Schmidt, Brand-Erbisdorf (DE)
(73) Assignee: SIEMENS AKTIENGESELLSCHAFT, Munich (DE)

( * ) Notice: Subject to any disclaimer, the term of this patent is extended or adjusted under 35 U.S.C. 154(b) by 428 days.

(21) Appl. No.: 14/005,173
(22) PCT Filed: Feb. 29, 2012
(86) PCT No.: PCT/EP2012/053430
§ 371 (c)(1), (2), (4) Date: Sep. 13, 2013
(87) PCT Pub. No.: WO2012/123256
PCT Pub. Date: Sep. 20, 2012
(65) Prior Publication Data
US 2014/0000331 A1 Jan. 2, 2014
(30) Foreign Application Priority Data
Mar. 14, 2011 (EP) ..... 11002088
(51) Int. Cl.
*B21B 1/02* (2006.01)
*B21B 1/22* (2006.01)
(Continued)
(52) U.S. Cl.
CPC . *B21B 1/026* (2013.01); *B21B 1/22* (2013.01); *B21B 1/38* (2013.01); *B21B 1/08* (2013.01);
(Continued)
(58) Field of Classification Search
CPC ..... B21B 1/026; B21B 1/30; B21B 1/32; B21B 39/20; B21B 1/08; B21B 1/22; B21B 1/0805; B21B 2001/028; B21B 2205/04; B21B 2263/02; B21B 2263/30
See application file for complete search history.

(56) References Cited

U.S. PATENT DOCUMENTS 4,238,946 A 12/1980 Tsubota
6,092,586 A 7/2000 Schönbeck

FOREIGN PATENT DOCUMENTS

CN 1850376 10/2006
DE 28 14 472 A1 10/1978
(Continued)

OTHER PUBLICATIONS

International Search Report for PCT/EP2012/053430; mailed Apr. 4, 2012.
(Continued)

*Primary Examiner* — Teresa M Ekiert
(74) *Attorney, Agent, or Firm* — Staas & Halsey LLP

(57) ABSTRACT

In a rolling train, prior to being rolled, the rolled stock, or slab, produced in an ingot casting process, has the shape of a truncated pyramid with a base area, a top area and four side areas. During a first rolling pass sequence, two opposite side areas of the rolled stock are rolled in a first direction so that all of the cross-sectional areas of the rolled stock oriented transversely with respect to the rolling direction have the same surface area when the sequence ends. The rolled stock is rotated, e.g., through 90°, and during a second rolling pass sequence, the same two opposite side areas of the rolled stock are rolled in a second direction transversely with respect to the first direction. Thus, material of the rolled stock is automatically redistributed to a desired geometry with a high degree of precision and without the use of vertical rolling stands.

8 Claims, 2 Drawing Sheets

(51) Int. Cl.
*B21B 1/38* (2006.01)
*B21B 1/08* (2006.01)

(52) U.S. Cl.
CPC ..... *B21B 1/0805* (2013.01); *B21B 2001/028* (2013.01); *B21B 2205/04* (2013.01); *B21B 2263/02* (2013.01); *B21B 2263/30* (2013.01)

(56) References Cited

FOREIGN PATENT DOCUMENTS

| | | | |
|---|---|---|---|
| DE | 196 13 718 | C1 | 10/1997 |
| DE | 19757486 | A1 | 6/1999 |
| EP | 0925850 | A2 | 6/1999 |
| EP | 11002088.0 | | 3/2011 |
| JP | 58-44904 | | 3/1983 |
| JP | 58044904 | A1 | 3/1983 |
| SU | 707621 | | 1/1980 |

OTHER PUBLICATIONS

European Search Report for 111002088.0; dated Sep. 13, 2011.

Office Action issued Sep. 3, 2014 in corresponding Chinese Patent Application No. 201280012149.0.

Machine Translation of Russian Publication No. 1784300, Published Dec. 20, 1992.

METHOD AND ROLLING TRAIN FOR ROLLING A ROLLED STOCK PRODUCED IN AN INGOT CASTING PROCESS, OPEN- AND/OR CLOSED-LOOP CONTROL DEVICE FOR A ROLLING TRAIN, MACHINE-READABLE PROGRAM CODE FOR AN OPEN- AND/OR CLOSED-LOOP CONTROL DEVICE, AND STORAGE MEDIUM

CROSS REFERENCE TO RELATED APPLICATIONS

This application is the U.S. national stage of International Application No. PCT/EP2012/053430, filed Feb. 29, 2012 and claims the benefit thereof. The International Application claims the benefit of European Application No. 11002088.0 filed on Mar. 14, 2011, both applications are incorporated by reference herein in their entirety.

BACKGROUND

Described below is a method for rolling a rolled stock produced in an ingot casting process, known as a slab or an ingot, in a rolling train, wherein, prior to being rolled, the rolled stock has the shape of a truncated pyramid with a base area, a top area and four side areas. Also described is a rolling train for rolling such a rolled stock, an open- and/or closed-loop device for such a rolling train, a machine-readable program code for an open- and/or closed-loop device of the kind, and a storage medium for a machine-readable program code of the kind.

With many rolled stocks it makes no sense economically to manufacture them as continuous casting products, since too few of the rolled stocks are used. Such a rolled stock is in that case produced e.g. in an ingot casting process and prior to the rolling operation is referred to as a "slab". After rolling the slab forms a sheet or strip, ideally having a cuboidal shape. In ingot casting, an ingot mold is used which is implemented in a slightly conical shape, with its cross-section tapering downward. Because of the special shape of the ingot mold, the slab is detached completely from the ingot mold wall after solidifying when the slab is pressed out of the ingot mold by special tongs. Without the conicity or convergence of the ingot mold it would not be possible to release the slab from the mold. However, the slab takes on the shape of the ingot mold and subsequently there is the problem that the double conicity of the slab, i.e. a thickness wedge and a width wedge of the slab, must be removed during rolling.

A major problem in the rolling of slabs is to achieve a basic rectangular shape with a constant width over the length of the sheet or strip. Present-day practice in order to influence the width of the slab is to employ vertically aligned compression rollers which make the hot-rolled strip thicker in a longitudinal edge region and consequently can reduce the width of the strip in a certain area.

DE 196 13 718 C1 and DE 197 57 486 A1 each disclose a system for producing hot-rolled strip, wherein upstream of a first horizontal rolling stand a vertical rolling stand is provided by which the two longitudinal edge regions of a cast semifinished product are compressed. However, a reduction in the width of the slab is limited.

Complete removal of the width wedge of ingot cast slabs is often not possible using standard designs of vertical stands, however, since the vertical stands cannot be implemented with sufficient strength. Furthermore, the back-spreading of the material of the slab occurring during the vertical rolling would necessitate an overcompensation of the width wedge. The back-spreading takes place because the width reduction is not distributed evenly over the width, but instead the two longitudinal edge regions of the slab are more severely reformed. So-called dogbones are produced as a result.

SUMMARY

Described below is the processing of a slab having a truncated pyramid shape into a sheet or strip having a basic rectangular shape with maximally uniform width and thickness in which the use of vertical rolling stands is not provided.

According to the method described below for rolling a rolled stock produced in an ingot casting process in a rolling train, prior to being rolled the rolled stock has the shape of a truncated pyramid with a base area, a top area and four side areas, then:

- during a first rolling pass sequence, two opposite side areas of the rolled stock are rolled in a first direction in such a way that at the end of the first rolling pass sequence all of the cross-sectional areas of the rolled stock that are oriented transversely with respect to the rolling direction have the same surface area,
- the rolled stock is rotated, in particular through 90°, and
- during a second rolling pass sequence, the same two opposite side areas of the rolled stock are rolled in a second direction transversely with respect to the first direction.

The term "rolled stock" in this context refers both to the slab or ingot prior to rolling and to its intermediate shapes and the final shape that it assumes during and after rolling, respectively. Moreover, what is to be understood by "rolling pass sequence" is a series of rolling passes without rotation of the rolled stock.

Prior to the rolling operation, the rolled stock or slab produced in an ingot mold during ingot casting has a thickness wedge and a width wedge caused by the geometry of the ingot mold. The slab therefore has the shape of a truncated pyramid with a base area, a top area which is smaller than the base area, and four side areas forming a lateral surface. During rolling, the slab is positioned with one side area lying in a horizontal contact plane. During the rolling pass, the "downward" oriented side area, as well as the opposite side area which is directed "upward", come into contact with the working rollers of the rolling stands of the rolling train, if the rolling stands are horizontal rolling stands.

The slab is wherein a length, the length of the slab being defined by the distance between the base area and the top area. A width of the slab runs in the contact plane transversely with respect to the length, and a thickness of the slab extends substantially at right angles with respect to the contact plane. The slab is usually moved with its top area facing forward into a rolling gap between the working rollers of the rolling stands; alternatively, however, it can also be moved sideways, i.e. with one of the side areas facing forward, into the rolling gap, this being dependent on the size of the slab. The rolled stock is rotated through 90° in the contact plane, i.e. the side area with which the rolled stock is positioned lying in the contact plane continues to remain in the contact plane after the rotation, and only the orientation of the base area, the top area and the other two side areas changes with respect to the rolling gap.

The method is based on the idea of enabling, in a two-stage or multistage rolling operation, a favorable distribution of material by which the desired cuboid shape is achieved in a simple manner. This optimal material distribution is realized in that at the end of the first rolling pass sequence, viewed in the rolling direction, all of the cross-sectional areas of the rolled stock between the base area and the top area have the same surface area. As a result, the wedge-shaped profile of the rolled stock in the first direction in particular is inverted. During inversion, the direction of the converging profile is changed after the rolling, such that a diverging profile is present in its place. To put it another way: a thickening of the slab is replaced by a narrowing in the rolling direction. At the end of this operation, the base area, the top area and all of the cross-sectional areas between the base area and the top area have the same surface area, i.e. the product of width and thickness is always the same in the rolling direction. The redistribution of the material of the rolled stock resulting from the inversion of the wedge-shaped profile of the two opposite side areas, combined with the rolling of the rolled stock in two directions standing transversely with respect to each other enables the desired geometry to be set fully automatically and with a high degree of precision with the aid of a rolling train, whereby the use of vertical rolling stands is not necessary. Depending on the desired final geometry of the rolled stock, an activation of the rolling train is also conceivable in which the original surface gradient is not completely removed or overcompensated for in the rolling direction.

According to an embodiment variant, rolling takes place in the longitudinal direction of the rolled stock during the first rolling pass sequence, with the result that in particular the thickness wedge of the rolled stock is inverted. The rolling pass sequence can be performed on a plurality of rolling stands, with in particular one rolling stand being provided for each pass. The rolling pass sequence can, however, also be performed on few or even on only one rolling stand in a reversible mode of operation in which the rolling direction changes in alternation. In this case the rolling operation starts in the longitudinal direction of the rolled stock and the first rolling pass sequence, referred to hereinafter as the roughing sequence, serves to reduce the original difference in thickness in the longitudinal direction of the rolled stock and to establish in its place a new thickness gradient, albeit in the opposite direction to the first thickness gradient. In this case the length of the rolled stock is increased in particular.

After the first rolling pass sequence, the rolled stock is rotated through 90°, such that it is, as it were, moved sideways into the rolling gap. In this case, as part of the second rolling pass sequence, a width wedge of the rolled stock may be reduced. "Reduced" in this case means that after the second rolling pass sequence a uniform width of the rolled stock is established and no width gradient is present. What is important during the rotation is that the side area lying on a roller table of the rolling train also remains lying on the roller table following the rotation. The rotation is therefore performed only about the normal vector standing on this one side area. The described rotation about the normal vector of the side area lying on the roller table is accomplished in particular by a rotary roller table. This is wherein three features:

a) The roller table rollers have slightly different diameters on the right and left (i.e. they are not cylinders, but rather truncated cones or are composed of two cylinders of different diameters).

b) The roller table rollers are arranged on the roller table in such a way that alternately on one side rollers (e.g. all even-numbered rollers) with their large diameter are followed on by rollers (e.g. all odd-numbered rollers) with their small diameter toward the same side.

c) The rollers are driven individually.

If all the rollers rotate in the same direction, the rolled stock is conveyed "normally". However, if the odd-numbered rollers are rotated in the opposite direction to the even-numbered ones, the rolled stock rotates about the normal vector standing on the roller table plane.

According to another embodiment variant, the rolled stock is rolled with the aid of at least one rolling stand, which is set in such a way that during each rolling pass the two opposing side areas of the rolled stock are rolled in the rolling direction over their entire length by the working rollers of the rolling stand. This constitutes a continuous rolling operation in which during each rolling pass the working rollers of the at least one rolling stand come into contact with the side areas in the rolling direction over their entire length. There is therefore a dynamic regulation of the height of the rolling gap present in which the dimension or height of the rolling gap is actively adjusted during the rolling pass. In each rolling pass during the continuous rolling operation, a change in the thickness of the rolled stock is effected over the entire length of the rolled stock in the rolling direction. The continuous procedure therefore has the advantage that a greater change in the geometry of the rolled stock is achieved by a small number of rolling passes.

At least two rolling pass sequences are necessary in order to produce the desired geometry of the rolled stock, with rolling being performed in the longitudinal direction in one pass sequence and in the width direction in the other. With regard to achieving a very high degree of precision when setting the desired geometry, minor corrections to the shape of the rolled stock can be carried out after the second rolling pass sequence by rotating the rolled stock a further time through 90° and performing a further rolling pass sequence once more in the first direction.

The length of the rolling train is minimized by operating the rolling train in a reversible manner, i.e. at least one of the rolling stands of the rolling train is operated reversibly. In this case a high number of passes are performed on a small number of rolling stands. In the interests of a particularly space-saving solution, all the rolling passes are performed on a single rolling stand, i.e. the rolling trains include only one rolling stand, which can be operated in a reversible manner.

Also described below is a rolling train for rolling a rolled stock produced in the shape of a truncated pyramid in an ingot casting process, including at least one rolling stand for rolling the rolled stock in a first direction and in a second direction transversely with respect to the first direction, as well as means for rotating the rolled stock through 90°.

An open- and/or closed-loop control device may be used to control the rolling train of the aforesaid type, the device having a machine-readable program code including control commands which, upon execution of the program code, cause the open- and/or closed-loop control device to perform a method according to one of the above-described embodiments.

The machine-readable program code for an open- and/or closed-loop control device for the rolling train includes control commands which cause the open- and/or closed-loop control device to perform the method according to one of the above-described embodiments.

A storage medium may store the machine-readable program code.

The advantages cited in respect of the method are to be applied analogously to embodiments of the rolling train and the open- and/or closed-loop control device.

BRIEF DESCRIPTION OF THE DRAWINGS

These and other aspects and advantages will become more apparent and more readily appreciated from the following description of an exemplary embodiment, taken in conjunction with the accompanying drawings of which.

DETAILED DESCRIPTION OF THE PREFERRED EMBODIMENT

Figure 1:
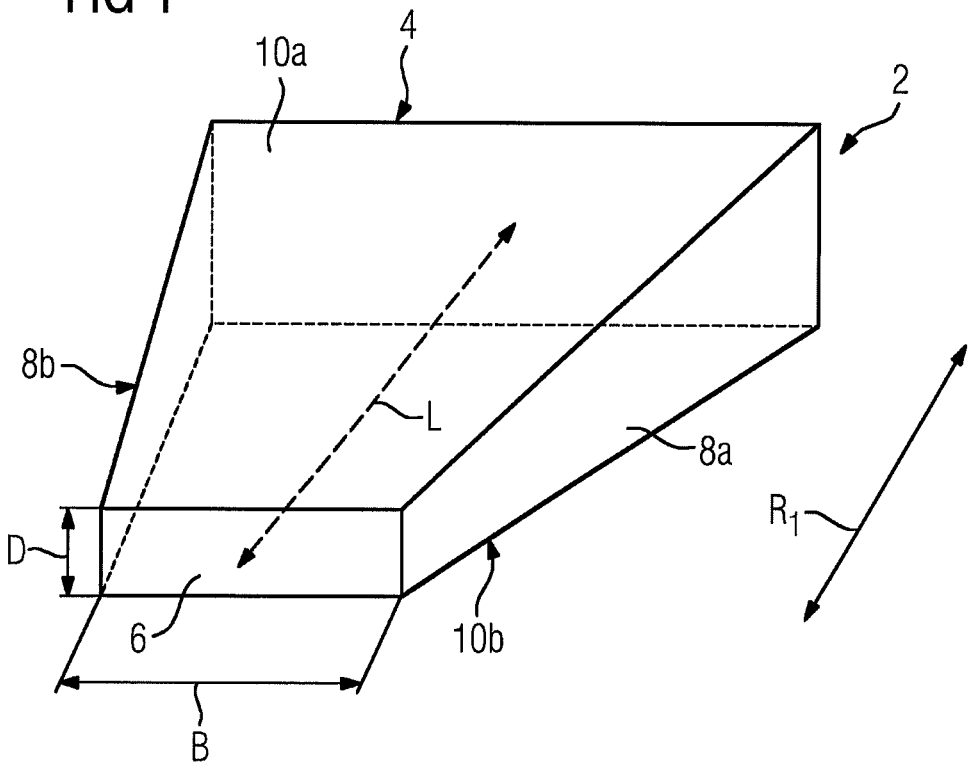
FIG. 1 is a perspective view of rolled stock prior to the rolling operation.

Reference will now be made in detail to the preferred embodiments, examples of which are illustrated in the accompanying drawings, wherein like reference numerals refer to like elements throughout.

The same reference signs have the same meaning in the different figures.

FIG. 1 shows a slab, hereinafter also referred to as rolled stock 2, which has been produced in an ingot casting process. In this exemplary embodiment the slab 2 is a so-called ingot, i.e. a block made of a semiconductor material such as silicon. In order to produce the ingot, the silicon has been melted down and poured into an ingot mold that is not shown in more detail here. After the compound has solidified in the ingot mold, the slab 2 is extracted from or pressed out of the ingot mold. This is possible owing to the slightly conical shape of the ingot mold. Accordingly, the slab 2 likewise has a double conicity which manifests itself in a thickness wedge and a width wedge which must be removed during rolling, in particular during hot-rolling.

As can be seen from FIG. 1, prior to hot-rolling the rolled stock 2 has the shape of a truncated pyramid, with a base area 4, a top area 6 and two pairs of oppositely disposed, trapezoidal side areas 8*a*, 8*b* and 10*a*, 10*b*. In this case the side area 10*b* forms a bottom side area on which the rolled stock 2 rests during rolling. The opposite side area 10*a* is directed substantially upward and is open. The rolled stock 2 in its original form is wherein a length L which substantially corresponds to the distance between the base area 4 and the smaller top area 6. Furthermore, the rolled stock 2 has a varying width B, which is defined at right angles to the length L, and a likewise varying thickness D, which projects out of the contact plane of the side area 10*b* and which increases constantly between the top area 6 and the base area 4.

Figure 3:
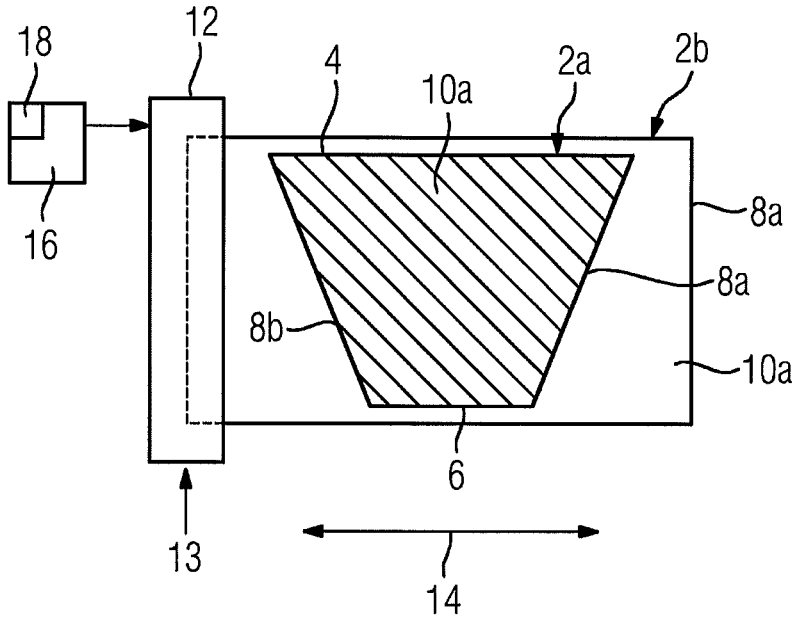
FIG. 3 is an overlaid plan view onto an intermediate geometry of the rolled stock prior to a second rolling pass sequence as well as onto the final geometry of the rolled stock after a second rolling pass sequence.

In order to remove the thickness gradient and the width gradient, the rolled stock 2 is rolled with the aid of a rolling train 13 which is indicated in FIG. 3. The rolling train 13 can include a plurality of rolling stands, though in the exemplary embodiment shown it includes only a single, horizontal rolling stand 12, which is indicated symbolically in FIG. 3 by the block 12. The rolling stand 12 is operated reversibly, i.e. the rolling stand can reverse a rolling direction 14. For the purpose of controlling the rolling stand 12 or rolling train 13, an open- and/or closed-loop control device 16 is provided which includes a program code 18 stored on a storage medium that is not shown in more detail here. The program code includes control commands upon the execution of which the open- and/or closed-loop control device 16 actuates the rolling train 13 in a suitable manner in order to produce the desired geometry of the rolled stock.

At the commencement of the rolling operation, the rolled stock 2 according to FIG. 1 is moved with its base area 4 or its top area 6 facing forward into a rolling gap (not shown in more detail here) between two working rollers of the rolling stand 12. During the first pass, the rolled stock 2 may be moved with the top area 6 facing forward into the rolling gap and rolled in the direction of its length L. In this case the rolling gap of the rolling stand 12 is set in such a way that during each rolling pass the side areas 10*a* and 10*b* come into contact over their entire length with the working rollers, i.e. the working rollers roll away over the entire length of the rolled stock 2 in the rolling direction.

Figure 2:
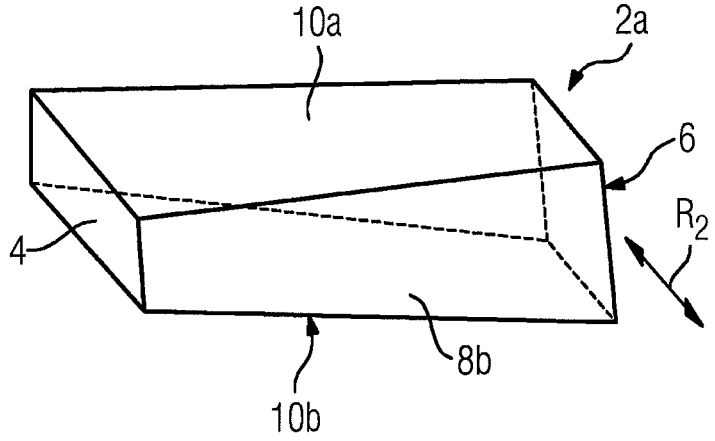
FIG. 2 is a perspective view of the rolled stock according to FIG. 1 after a first rolling pass sequence.

Multiple rolling passes are necessary in order to remove the thickness gradient of the rolled stock 2. This first rolling pass sequence is referred to as a roughing sequence. At the end of the roughing sequence, the wedge-shaped profile from the top area 6 to the base area 4 is inverted, with the result that the top area 6 is now thicker than the base area 4. This intermediate geometry of the rolled stock 2*a* is shown in FIG. 2. Following the roughing sequence, the rolled stock 2*a* has the shape of an irregular hexahedron in which the side areas 8*a*, 8*b*, 10*a*, 10*b* are still embodied in a trapezoidal shape, though two adjacent side areas 8*a*, 8*b*, 10*a*, 10*b* in each case converge in the opposite direction. At this stage the rolled stock 2*a* has the property that in the longitudinal direction (L) the base area 4, the top area 6 and all of the cross-sectional areas in the longitudinal direction (L) of the rolled stock (2) have the same surface area or surface contents in spite of their different geometries. This means that for each point (x) the product of the width b(x) and the thickness d(x) of the rolled stock is the same as that of the preceding or succeeding cross-section:

$$b(x-1)*d(x-1)=b(x)*d(x)=b(x+1)*d(x+1) \text{ for } x \text{ from } 0 \text{ to } L$$

This material distribution is critical for the further procedure, since, starting from this geometry of the rolled stock 2*a*, the desired cuboid shape can be achieved in only a small number of rolling passes if the rolled stock 2*a* is rolled at right angles to its longitudinal direction.

Following the termination of the roughing sequence, the rolled stock 2*a* is therefore rotated through approximately 90°, in which case it continues to rest on its downward-directed side area 10*b*. During the rotation the rolled stock 2 is oriented in such a way in relation to the rolling stand 12 that the rolled stock 2 is moved with its lateral side areas 8*a*, 8*b* into the rolling gap of the rolling stand 12. The displacement directions of the rolled stock 2*a* during a second rolling sequence, a so-called spreading sequence, are indicated in FIG. 3 by the arrow 14. In this case the hatched trapezoid shows the rolled stock 2*a* prior to the spreading sequence and the overlaid white block 2*b* represents the rolled stock 2 at the end of the spreading sequence. This second rolling pass sequence serves to reduce the width gradient. The desired sheet shape is substantially achieved at the end of this rolling pass sequence.

Figure 4:
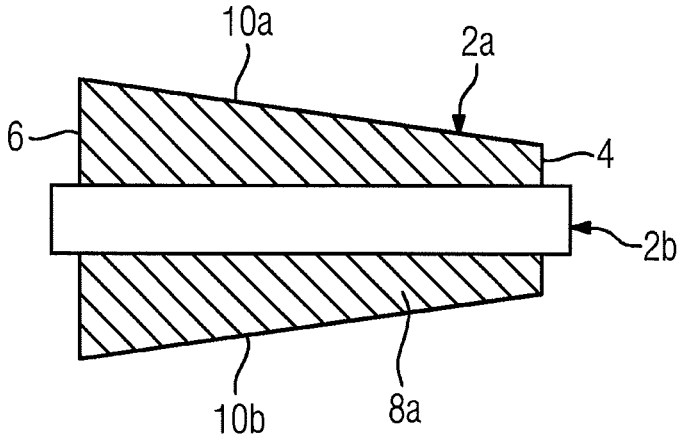
FIG. 4 is a cross-section through the intermediate geometry and the final geometry of the rolled stock accordingly prior to the rolling and after the end of the rolling operation.

FIG. 4 illustrates the orientation of the rolled stock 2 with respect to the rolling gap during the spreading sequence. The hatched tetragon shows the rolled stock 2 before the spreading sequence and the white rectangle 2*b* shows a cross-section through the rolled stock 2 after the spreading sequence.

At the termination of the rolling operation, the rolled stock 2 can optionally be rotated again through 90° and rolled further as part of a finishing sequence in order to achieve a particularly high degree of precision in the desired shape of the rolled stock 2.

During the spreading sequence also, as well as during the finishing sequence, where applicable, continuous rolling of the side areas 10*a*, 10*b* takes place in which the working rollers of the rolling stand 12 come into contact with the side areas 10*a*, 10*b* over their entire length in the rolling direction. Compared with conventional, non-continuous rolling methods for processing slabs, in particular by vertical rolling stands, this procedure has the advantage that a greater surface area of the rolled stock 2 is processed in each rolling pass and that back-spreading effects are substantially avoided.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A method for rolling a rolled stock, produced in an ingot casting process, in a rolling train, where the rolled stock, prior to being rolled in a rolling direction, has a truncated pyramid shape with a base area, a top area and four side areas, said method comprising:

rolling, during a first rolling pass sequence, two opposite side areas of the rolled stock in a first direction, so that upon completion of the first rolling pass sequence, all cross-sectional areas of the rolled stock that are oriented transversely with respect to the rolling direction have identical surface areas;

rotating the rolled stock; and rolling, during a second rolling pass sequence, the two opposite side areas of the rolled stock in a second direction transversely with respect to the first direction.

2. The method as claimed in claim 1, wherein during the first rolling pass sequence, said rolling takes place along a length of the rolled stock.

3. The method as claimed in claim 2, wherein during the second rolling pass sequence, said rolling takes place along a width of the rolled stock and a width wedge of the rolled stock is reduced.

4. The method as claimed in claim 3, wherein the rolled stock is rolled with the aid of at least one rolling stand and the rolling stand is set in such a way that during each rolling pass the two opposing side areas of the rolled stock are rolled in the rolling direction over their entire length by working rollers of the rolling stand.

5. The method as claimed in claim 4, further comprising, after the second rolling pass sequence:

rotating the rolled stock; and rolling the rolling stock in the first direction in a third rolling pass sequence.

6. The method as claimed in claim 5, wherein the rolling train is operated in a reversible manner.

7. The method as claimed in claim 6, wherein all of the rolling pass sequences are performed on a single rolling stand.

8. A non-transitory storage medium embodying machine-readable program code that when executed causes a control device for a rolling train to execute a method for rolling a rolled stock, produced in an ingot casting process, in a rolling train, where the rolled stock, prior to being rolled in a rolling direction, has a truncated pyramid shape with a base area, a top area and four side areas, said method comprising:

rolling, during a first rolling pass sequence, two opposite side areas of the rolled stock in a first direction, so that upon completion of the first rolling pass sequence, all cross-sectional areas of the rolled stock that are oriented transversely with respect to the rolling direction have identical surface areas;

rotating the rolled stock; and rolling, during a second rolling pass sequence, the two opposite side areas of the rolled stock in a second direction transversely with respect to the first direction.

* * * * *